US006456813B1

(12) United States Patent
Sato

(10) Patent No.: US 6,456,813 B1
(45) Date of Patent: Sep. 24, 2002

(54) DEVELOPING APPARATUS AND IMAGE FORMING APPARATUS THAT MAINTAINS A SUBSTANTIALLY CONSTANT CHARGE AMOUNT PER UNIT WEIGHT OF DEVELOPING AGENT

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/660,384

(22) Filed: Sep. 12, 2000

(30) Foreign Application Priority Data

Sep. 28, 1999 (JP) ..... 11-274115

(51) Int. Cl.[7] ..... G03G 15/08
(52) U.S. Cl. ..... 399/284; 399/274
(58) Field of Search ..... 399/258, 284, 399/274, 272, 281

(56) References Cited

U.S. PATENT DOCUMENTS 5,052,335 A * 10/1991 Enoguchi et al. ..... 118/658
5,338,895 A * 8/1994 Ikegawa et al. ..... 118/661
5,438,398 A * 8/1995 Tanigawa et al. ..... 399/302
5,761,590 A * 6/1998 Sato ..... 399/284 X
5,809,386 A * 9/1998 Iwata ..... 399/281
5,842,091 A * 11/1998 Nakano ..... 399/258
6,229,980 B1 * 5/2001 Ogata et al. ..... 399/283

* cited by examiner

*Primary Examiner*—Quana M. Grainger
(74) *Attorney, Agent, or Firm*—Oliff & Berridge, PLC

(57) ABSTRACT

A developing apparatus in which variations in density caused by different development histories are reduced, and a high-quality halftone image is reproduced. When m1 represents a weight per unit area of a thin layer of developing agent that is pressed again by a layer thickness-regulating member while having been carried on the surface of a developing agent carrier that corresponds to an area of a photosensitive member where no visible image has been formed, and m2 represents the weight per unit area of a thin layer of developing agent that is pressed by the layer thickness-regulating member after being newly supplied to the surface of the developing agent carrier that corresponds to an area of the photosensitive member where a solidly shaded visible image has been formed, the following equation is satisfied:

$$m_2 = cm_1 \ (0.75 \leqq c \leqq 0.95).$$

11 Claims, 2 Drawing Sheets

DEVELOPING APPARATUS AND IMAGE FORMING APPARATUS THAT MAINTAINS A SUBSTANTIALLY CONSTANT CHARGE AMOUNT PER UNIT WEIGHT OF DEVELOPING AGENT

BACKGROUND OF THE INVENTION

1. Field of Invention

The invention relates to a developing apparatus provided to an image forming apparatus, such as a facsimile machine or a laser printer, and relates to an image forming apparatus provided with a developing apparatus.

2. Description of Related Art

A color laser printer using non-magnetic single-component toner has a plurality of developing cartridges, each having a developing roller that carries toner, and a layer thickness-regulating blade that is disposed at a side of the developing roller and presses a surface of the developing roller to form a thin layer of toner. In each of the developing cartridges, the layer thickness-regulating blade is pressed against the surface of the associated developing roller. Color toner supplied from the developing roller is sufficiently charged by being rubbed between the layer thickness-regulating blade and the developing roller, and is carried, as a thin layer of toner, on the developing roller.

In addition, in such a laser printer, a photosensitive drum is disposed so as to face the developing roller of each of the developing cartridges. A surface of the photosensitive drum is uniformly charged by a charger. After that, a laser beam emitted from a laser emitter, based on a predetermined image data, is scanned at high speed over the surface of the photosensitive drum, and an electrostatic latent image is formed thereon.

Then, the developing roller of each of the developing cartridges sequentially comes to face the photosensitive drum, and an electrostatic latent image formed on the photosensitive drum is developed, using the toner of each color, into a visible image. Then, the visible image of each color is sequentially transferred to an intermediate transfer drum to form a multicolored image. Finally, the multicolored image is transferred at a time from the intermediate transfer drum to a sheet of paper.

For reproduction of a high-quality halftone image, it is necessary to reduce variations in density of toner, carried on the surface of the developing roller, that is caused by different development histories of toner. Such variations in density are produced because the density of a halftone visible image to be developed when a thickness-regulated layer of toner remains on the surface of the developing roller without having been used for developing the entire surface of the photosensitive drum (when a blank image has been developed on the entire surface of the photosensitive drum) defers the density of a halftone visible image to be developed when only new toner is supplied and carried, as a thickness-regulated layer, on the surface of the developing roller after the entire surface of the photosensitive drum has been developed using toner (when a color image has been developed on the entire surface of the photosensitive drum).

To eliminate such variations in density, it is necessary to equate the charge amount per unit weight $q_1$ of the toner, which is carried, as a thickness-regulated layer, on the surface of the developing roller after a blank image has been developed on the entire surface of the photosensitive drum, with the charge amount per unit weight $q_2$ of the toner, which is carried, as a thickness-regulated layer, on the surface of the developing roller after a color image has been developed on the entire surface of the photosensitive drum.

After a blank image has been developed on the entire surface of the photosensitive drum, already charged toner remains on the developing roller without having been consumed. Thus, at the next development, a visible image is developed using the remaining toner that is further stably charged. On the other hand, no toner remains on the developing roller after a color image has been developed on the entire surface of the photosensitive drum and, at the next development, a visible image is developed using the toner that is newly supplied to the developing roller and newly charged. Thus, as the former toner and the latter toner have different development histories, it is hard to equate their charge amounts.

Particularly, when color toner other than carbon black is used, it is hard to reduce variations in density because the color toner is slow to be charged, and the charge level will not be stabilized.

Further, the above-described variations in density are produced not only when the entire surface of the photosensitive drum is developed but also when partially solidly shaded portions are developed, as in the case where characters having a large font size are printed.

SUMMARY OF THE INVENTION

Therefore, the invention aims at producing a developing apparatus that can minimize variations in density caused by different development histories and can reproduce a high-quality halftone image.

In a developing device according to the invention, a non-magnetic single-component developing agent is used, and the charge amount of the developing agent carried, as a thin layer, on a developing agent carrier is adjusted to become substantially constant. With this adjustment, variations in density caused by different development histories can be reduced.

Particularly, when $m_1$ represents a weight per unit area of a thin layer of the developing agent that is pressed again by a layer thickness-regulating member while having been carried on the surface of the developing agent carrier that corresponds to an area of a photosensitive member where no visible image has been formed, and $m_2$ represents the weight per unit area of a thin layer of developing agent that is pressed by the layer thickness-regulating member after being newly supplied to the surface of the developing agent carrier that corresponds to an area of the photosensitive member where a solidly shaded visible image has been formed, the development apparatus is constructed so as to satisfy an equation that $m_2=cm_1$ ($0.75 \leqq c \leqq 0.95$). Further, it is more preferable that c is within a range of 0.80 to 0.90 ($0.80 \leqq c \leqq 0.90$).

When polymerized toner is used as the developing agent, flowability of the developing agent is improved. Thus, the developing agent is stably supplied to the developing agent carrier and solidly shaded images can be formed continuously.

When the above-described developing apparatus of the invention is used as a developing apparatus of a color laser printer, where color toner not containing carbon black as a charge control agent, for example, cyan, magenta, and yellow toner are used, effects produced uniquely by the invention become remarkable. This is because the toner not containing carbon black is slow to be charged and takes time to be charged to a certain level. Thus, particularly, a thin layer of the developing agent, which is pressed by the layer thickness-regulating member after being newly supplied to a surface of the developing agent carrier that corresponds to an area of the photosensitive member where a solidly shaded visible image has been formed, is not charged enough to be deposited on a subsequent electrostatic latent image on the photosensitive member. As a result, a ghost image is produced.

If the developing apparatus according to the invention is used for a color laser printer, production of such a ghost image can effectively be prevented.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
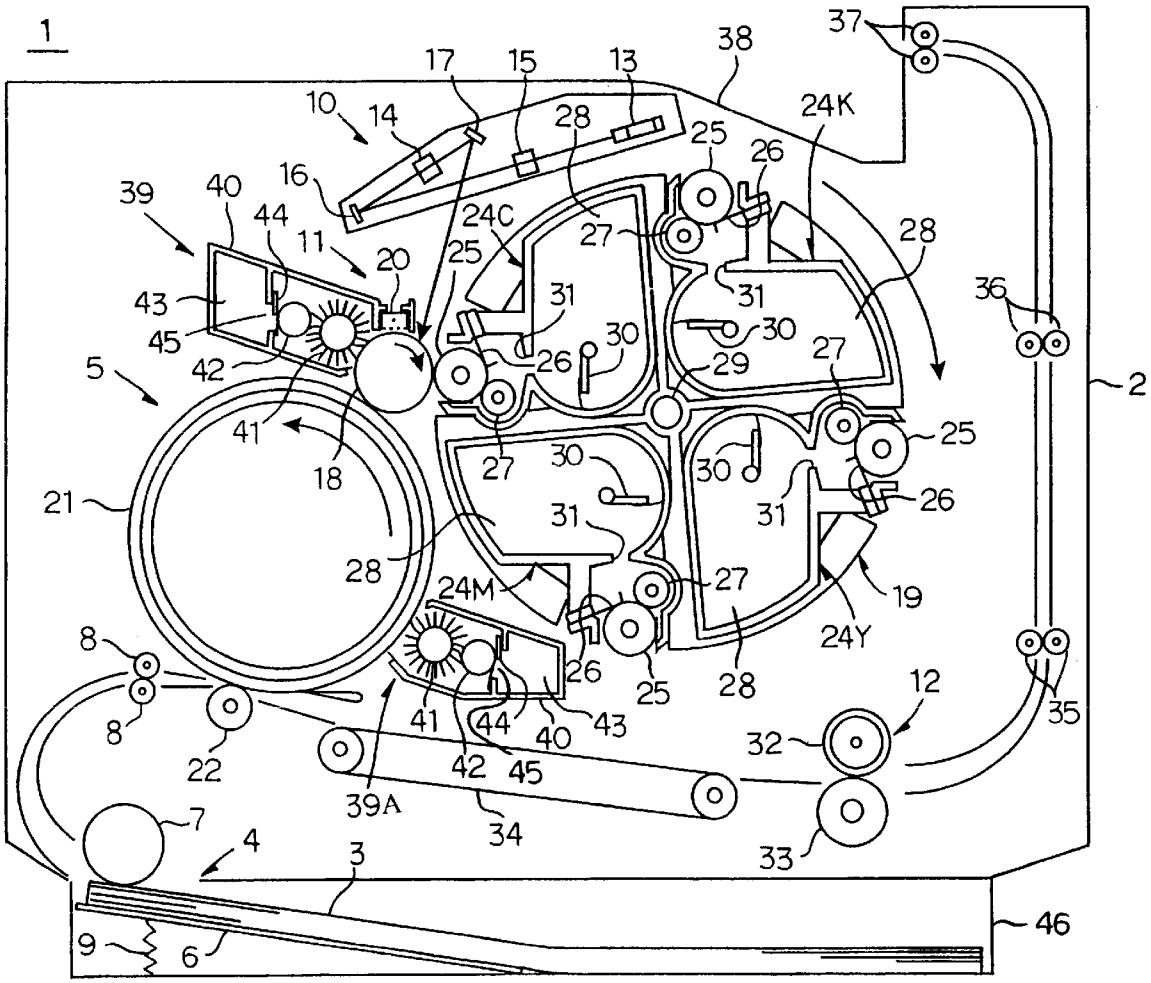
FIG. 1 is a sectional view of essential parts showing a color laser printer according to a preferred embodiment.

FIG. 1 is a sectional view of essential parts showing a color laser printer 1 according to an embodiment of the invention.

As shown in FIG. 1, the color laser printer 1 is provided with, in a body casing 2, a feeder unit 4 for feeding sheets of paper 3, and an image forming unit 5 for forming a predetermined image on a sheet 3 supplied thereto.

The feeder unit 4 has a sheet feed tray 46 for storing sheets of paper 3. The sheet feed tray 46 is detachably mounted to a bottom portion of the body casing 2. In the sheet feed tray 46, a sheet pressing plate 6 is provided so as to allow sheets 3 to be stacked thereon. A sheet feed roller 7 is disposed above an end portion of the sheet feed tray 46. Resist rollers 8 are provided downstream of the sheet feed roller 7, along the sheet conveying direction.

The sheet pressing plate 6 is, at its end remote from the sheet feed roller 7, turnably supported so that another end closer to the sheet feed roller 7 is vertically moved. The sheet pressing plate 6 is urged upward from its reverse side by a spring 9. As a stack of sheets 3 increases in quantity, the sheet pressing plate 6 is turned downward, about its end remote from the sheet feed roller 7, against the urging force from the spring 9. An uppermost sheet 3 of the stack on the sheet pressing plate 6 is pressed against the sheet feed roller 7 by the spring 9 provided on the reverse side of the sheet pressing plate 6, and is fed, one sheet at a time, by the rotation of the sheet feed roller 7. The resist rollers 8 include two rollers, that is, a driving roller and a driven roller. The resist rollers 8 resist a sheet 3 fed from the sheet feed roller 7 in a predetermined manner and convey the sheet 3 to the image forming unit 5.

The image forming unit 5 is provided with a scanning unit 10, a developing unit 11, and a fixing unit 12.

The scanning unit 10 is disposed at an upper potion within the body casing 2 and provided with a laser emitting portion (not shown), a rotationally driven polygon mirror 13, lenses 14, 15, and reflecting mirrors 16, 17. A laser beam emitted from the laser emitting portion, based on predetermined image data, sequentially passes through or is reflected by the polygon mirror 13, the lens 15, the reflecting mirror 16, the lens 14, and the reflecting mirror 17, in order as indicated by an arrow. The laser beam is thus scanned at high speed for irradiation of the surface of a photosensitive drum 18 (described later) of the developing unit 11.

The developing unit 11 is disposed below the scanning unit 10 and provided with the photosensitive drum 18, a rotary developing unit 19, a scorotron charger 20, an intermediate transfer drum 21, and a transfer roller 22.

The rotary developing unit 19 is cylindrical and has a driving shaft 29 at its center. Four developing cartridges, that is a cyan developing cartridge 24C, a magenta developing cartridge 24M, a yellow developing cartridge 24Y, and a black developing cartridge 24K are detachably attached around the driving shaft 29. Each of the developing cartridges 24C, 24M, 24Y, 24K is provided with a developing roller 25 as a developing agent carrier, a layer thickness-regulating blade 26 as a layer thickness-regulating member, a supply roller 27, and a toner chamber 28. The rotary developing unit 19 is structured such that as the driving shaft 29 rotates in the direction of an arrow (clockwise), the developing rollers 25 of the developing cartridges 24C, 24M, 24Y, 24K move in a circumferential direction of the driving shaft 29 and sequentially come to face the photosensitive drum 18.

The toner chambers 28 of developing cartridges 24C, 24M, 24Y, and 24K contain cyan, magenta, yellow, and black toner, respectively.

Positively charged non-magnetic single-component toner, which is either pulverized or polymerized toner, is used. More specifically, base particles of pulverized toner are made by mixing a coloring agent, a charge control agent, wax, and the like to a resin, and pulverizing the mixture. Toner used in this embodiment is obtained by further adding an external additive that is a powder of silica, alumina, titanium oxide, or the like to the base particles.

On the other hand, polymerized toner is mainly composed of a resin that is obtained by copolymerizing styrene-based monomers, such as styrene, and acryl-based monomers, such as acrylic acid, alkyl (C1–C4 ) acrylate, and alkyl (C1–C4)methacrylate, by a known polymerization method, such as suspension polymerization. Prior to polymerization, base particles of the polymerized toner are made by adding a coloring agent, a charge control agent, wax, and the like to the above-described polymerizable monomer. Further, an external additive that is a powder of silica, alumina, titanium oxide, or the like is added to the base particles.

It is preferable that two kinds of external additives are added to polymerized toner. One kind of external additive should have a mean particle size of less than 30 nm, and the other kind of external additive should have a mean particle size of 30 nm or more. The external additive having a mean particle size of less than 30 nm improves the flowability of the toner, while the external additive having a mean particle size of 30 nm or more prevents smaller external additive particles from sinking into toner base particles.

Cyan toner contained in the cyan developing cartridge 24C, magenta toner contained in the magenta developing cartridge 24M, and yellow toner contained in the yellow developing cartridge 24Y contain no carbon black as a coloring agent.

Toner in each of the toner chambers 28 is stirred by a rotatably provided agitator 30, and is discharged from a toner supply port 31 that is open at a side portion of the toner chamber 28.

The supply roller 27 is rotatably disposed at a side of the toner supply port 31. The developing roller 25 is rotatably disposed facing the supply roller 27. The supply roller 27 and the developing roller 25 are in contact with each other such that they are press-deformed against each other to an appropriate extent.

The supply roller 27 is formed by covering a metallic roller shaft with a roller part made of an electrically conductive foam material. On the other hand, the developing roller 25 is formed by covering a metallic roller shaft with a roller part made of an electrically conductive elastic material. More specifically, the roller part of the developing roller 25 is made of an electrically conductive urethane or silicone rubber containing fine carbon particles. The surface of the roller part of the developing roller 25 may be coated with a layer of fluorine-containing urethane or silicone rubber. The developing roller 25 is biased so as to produce a predetermined potential difference between the developing roller 25 and the photosensitive drum 18.

The layer thickness-regulating blade 26 is disposed near the developing roller 25 so as to press the surface of the developing roller 25. The layer-thickness regulating blade is made of a stainless plate with a bent end. The bent portion presses the surface of the developing roller 25. Toner enters a gap between the bent portion and the surface of the developing roller 25 to be formed into a thin layer, that is a few layers of toner, and is rotated integrally with the developing roller 25.

Toner discharged from the toner supply port 31 is supplied to the developing roller 25 as the supply roller 27 rotates. Toner is positively charged due to friction between the supply roller 27 and the developing roller 25. Toner supplied onto the developing roller 25 enters the gap between the layer thickness-regulating blade 26 and the developing roller 25, as described above, as the developing roller rotates 25. Then, toner is sufficiently charged due to friction between the developing roller 25 and the blade 26, and is carried as a thin layer of a predetermined thickness on the developing roller 25.

The photosensitive drum 18 is disposed so as to contact the developing roller 25 with intervention of toner when the photosensitive drum 18 faces, at a side of the rotary developing unit 19, each of the developing cartridges 24C, 24M, 24Y, 24K. The photosensitive drum 18 can rotate in the direction indicated by an arrow (clockwise). The photosensitive drum 18 is formed by coating a grounded aluminum cylindrical surface, with a positively charged organic photosensitive material that is mainly composed of polycarbonate.

The scorotron charger 20 is disposed above the photosensitive drum 18 leaving a predetermined interval therefrom. The scorotron charger 20 is a positively charging known scorotron charger that generates corona discharge from a tungsten charging wire, and positively and uniformly charges the surface of the photosensitive drum 10. Use of a positively charging scorotron charger reduces the amount of ozone generated to 1/10 of that generated by a negatively charging scorotron charger.

The intermediate transfer drum 21 faces and contacts the photosensitive drum 18 at a lower portion of the photosensitive drum 18, and is supported rotatably in the direction indicated by an arrow (counterclockwise). A transfer bias is applied to the intermediate transfer drum 21 such that a predetermined potential difference is produced between the intermediate transfer drum 21 and the photosensitive drum 18.

Color image forming operations by the color laser printer structured as described above will be described.

The scorotron charger 20 uniformly charges the surface of the photosensitive drum 18, while the photosensitive drum 18 rotates. The surface of the charged photosensitive drum 18 is irradiated with a laser beam emitted and scanned at high speed by the scanning unit 10. Then, an electrostatic latent image is formed on the photosensitive drum 18 based on predetermined image data. The electrostatic latent image represents portions that are irradiated with the laser beam and have a lower potential.

Then, as the rotary developing unit 19 rotates, the developing rollers of the developing cartridges 24C, 24M, 24Y, 24K sequentially come to face the photosensitive drum. At this time, each of the developing rollers 25 contacts the photosensitive drum 18 with intervention of toner carried on the surface of the developing roller 25. When each of the developing roller 25 rotates, toner that is positively charged and carried on the developing roller 25 is deposited on portions corresponding to an electrostatic latent image formed on the photosensitive drum 18, thereby turning the electrostatic latent image into a visible image. The visible image formed on the photosensitive drum 18 is transferred to the intermediate transfer drum 21 upon the application of a transfer bias to the transfer drum 21.

In this way, when the developing rollers 25 of the developing cartridges 24C, 24M, 24Y, 24K sequentially come to face the photosensitive drum 18, a visible image of each color is formed on the photosensitive drum 18 and then superimposed on the intermediate transfer drum 21, one image on another. Thereby, a multicolored image is formed on the intermediate transfer drum 21.

More specifically, when the developing roller 25 of the cyan developing cartridge 24C comes into contact with the photosensitive drum 18, a cyan visible image is formed on the photosensitive drum using cyan toner contained in the cyan developing cartridge 24C. Then, the visible cyan image is transferred to the intermediate transfer drum 21. After that, when the rotary developing unit 19 rotates, the developing roller 25 of the cyan developing cartridge 24C leaves the photosensitive drum 18, and the developing roller 25 of the magenta developing cartridge 24M comes into contact with the photosensitive drum 18. Then, a magenta visible image is formed on the photosensitive drum using magenta toner contained in the magenta developing cartridge 24M. The magenta visible image is transferred to the intermediate transfer drum 21 so as to be interposed on the already transferred cyan visible image. Similar operations are repeated using yellow toner contained in the yellow developing cartridge 24Y and black toner contained in the black developing cartridge 24K. Finally, a multicolored image is formed, using cyan, magenta, yellow, and black toner, on the intermediate transfer drum 21.

The transfer roller 22 is rotatably disposed below the intermediate transfer drum 21, in face-to-face contact with the intermediate transfer drum 21. The transfer roller 22 is formed by coating a metallic shaft with a roller part made of an electrically conductive rubber material. A transfer bias is applied to the roller shaft of the transfer roller 22 such that a predetermined potential difference is produced between the transfer roller 12 and the intermediate transfer drum 21. Thus, the multicolored image formed on the intermediate transfer drum 21 is altogether transferred to a sheet of paper 3, while the sheet is passing between the intermediate transfer drum 21 and the transfer roller 22. The sheet 3 with a transferred multicolored image is conveyed to the fixing unit 12 by a conveying belt 34 disposed downstream of the transfer roller 22.

The fixing unit 12 is provided with a heat roller 32 and a pressing roller 33 that is pressed against the heat roller 32.

The fixing unit 12 is disposed below the rotary developing unit 19 and downstream of the transfer roller 22. The heat roller 32 is formed by a metallic cylindrical roller coated with a urethane rubber, within which a halogen lamp is provided for heating. The fixing unit 12 thermally melts the multicolored image transferred to the sheet 3 to fix the image onto the sheet 3, while the sheet 3 is passing between the heat roller 32 and the pressing roller 33. Then, the sheet 3 is conveyed by pairs of discharge rollers 35, 36, 37, and is discharged onto an output tray 38.

The color laser printer 1 is provided with a cleaner 39 that reclaims toner remaining on the photosensitive drum 18 after the visible image on the photosensitive drum 18 is transferred to the intermediate transfer drum 21. The cleaner 39 includes a cleaner casing 40, disposed at a side of the photosensitive drum 18, in which a cleaner brush 41, a reclaim roller 42, a reclaim box 43, and a scraping blade 44 is accommodated. The cleaner casing 40 is integrally formed with a casing of the scorotron charger 20.

The cleaner brush 41, formed by a cylindrical body with a radial brush, is rotatably disposed at a side of the photosensitive drum 18, in face-to-face contact with the photosensitive drum 18. The cylindrical body is biased to produce a predetermined potential difference between the cylindrical body and the photosensitive drum 18.

The reclaim roller 42, formed by a metallic roller, is rotatably disposed at a side of the cleaner brush 41, in face-to-face contact with the cleaner brush 41. The reclaim roller 42 is biased to produce a predetermined potential difference between the reclaim roller 42 and the cleaner brush 41.

The reclaim box 43, disposed at a side of the reclaim roller 42, has an opening at a portion facing the reclaim roller 42. The scraping blade 44, which is pressed into contact with the reclaim roller 42, is provided adjacent to the opening 45.

After the visible image is transferred to the intermediate transfer drum 21, toner remaining on the photosensitive drum 18 comes to face the cleaner brush 41 as the photosensitive drum 18 rotates. The remaining toner is scraped by the cleaner brush 41 and adheres to the cleaner brush 41 due to the bias applied the brush 41. When the remaining toner having adhered to the cleaner brush 41 comes to face the reclaim roller 42, it adheres to the reclaim roller 42 due to a bias applied to the reclaim roller 42. Then, the toner is scraped by the scraping blade 44 and reclaimed into the reclaimed box 43.

A cleaner 39A, that has substantially the same structure as the cleaner 39, is disposed at a side of the intermediate transfer drum 21. The cleaner 39A reclaims toner remaining on the intermediate transfer drum 21 after the image is transferred to the sheet 3. However, no scorotron charger is provided in a cleaner casing 40A of the cleaner 39A.

In the color laser printer 1 structured as described above, the weight per unit area of toner, which is regulated in thickness on the developing roller 25 by the layer thickness-regulating blade 26, is defined.

The weight per unit area of toner that has not been consumed at all when no electrostatic latent image has been formed on the photosensitive drum 18 and that is recharged by the layer thickness-regulating blade 26 is expressed as $m_1$ [mg/cm$^2$]. On the other hand, the weight per unit area of toner that is newly carried on the developing roller 25 and frictionally charged by the layer thickness-regulating blade 26 after toner carried at a particular portion of the developing roller 25 has been deposited on an electrostatic latent image on the photosensitive drum 18 and completely consumed is expressed as $m_2$ [mg/cm$^2$]. In this embodiment, a condition that $m_2=cm_1$ ($0.75 \leqq c \leqq 0.95$) is satisfied.

When this condition is satisfied, the amount of toner, carried on the developing roller 25 and used for the next development after a color, solidly shaded image has been formed on the photosensitive drum 18, is smaller than the amount of toner, carried on the developing roller 25 and used for the next development after an image subjected to no toner deposition has been formed on the photosensitive drum. At this time, as the latter toner is recharged by the layer thickness-regulating blade 26 after being charged by the same blade 26, the charge amount of the latter toner is greater than that of the former toner. Accordingly, by making the amount of former toner smaller than the amount of latter toner, the charge amount per unit weight of the former toner becomes equal to that of the latter toner. In this way, by equating the charge amounts per unit weight (Q/M) of the former toner and the latter toner, variations in density caused by different development histories of the toner can be reduced. Consequently, a high-quality halftone image can be reproduced. Particularly, such effects are remarkable when color toner, except for black toner, is used, that is when cyan, magenta, and yellow toner are used as described in this embodiment. This is because black toner normally contains carbon black that makes the black toner quick to be charged, and the difference in the charge amount per unit weight between the above-described former toner and the latter toner becomes extremely small, and thus variations in density are unlikely to occur.

Further, it is preferable that $0.80 \leqq c \leqq 0.90$. When c falls within this range, the charge amounts per unit weight (Q/M) of the former toner and the latter toner become closer, and a higher-quality halftone image can be reproduced. If c is less than 0.75, $m_2$ becomes too small, and the charge amount per unit weight of toner used to form an image immediately after a color, solidly shaded image has been formed is reduced. That is, the amount of toner deposited on an electrostatic latent image is reduced. As a result, the amount of deposited toner varies between a portion where the color, solidly shaded image has been formed and the surrounding portions. More specifically, the amount of toner deposited on the portion where the color, solidly shaded image has been formed is reduced and, as a result, the density in that portion becomes lower compared to the surrounding portions. When color toner is used in the color laser printer, the density of a halftone portion is reduced. This kind of phenomenon is called a negative ghost.

On the other hand, when c is more than 0.95, $m_2$becomes too great, and the charge amount per unit weight of toner used to form an image immediately after a color, solidly shaded image has been formed is increased. That is, the amount of toner deposited on an electrostatic latent image is increased. As a result, the amount of deposited toner varies between a portion where the color, solidly shaded image has been formed and the surrounding portions. More specifically, the amount of toner deposited on the portion where the color, solidly shaded image has been formed is increased and, as a result, the density in that portion becomes higher compared to the surrounding portions. When color toner is used in the color laser printer, the density of a halftone portion is increased. This kind of phenomenon is called a positive ghost.

Factors satisfying the above-described condition that $m_2=cm_1$ ($0.75 \leqq c \leqq 0.95$) include the material, shape, and pressing force of portions of the developing roller 25 and the layer thickness regulating blade that make contact with toner. On the other hand, factors related to toner include the physical property (such as the acid value that determines the charging property) and type of a resin as a main component of the toner, the type and quantity of a charge control additive, and the type and quantity of an external additive. Appropriate combinations of these factors satisfy the condition that $m_2=cm_1$ ($0.75 \leqq c \leqq 0.95$).

When color, solidly shaded images are continuously formed, toner supply tends to become insufficient in the color laser printer structured as described above, and certain combinations of these factors may not allow formation of continuous stable images.

In such cases, it is preferable to use polymerized toner having a mean particle size of approximately 5 μm. Polymerized toner having excellent flowability allows stable toner supply to the developing roller 25, and stable solidly shaded images can be formed continuously even under unfavorable conditions for such image formation.

Further, in this embodiment, an external additive having a mean particle size of 30 nm is added to the toner, together with an external additive having a mean particle size of less than 30 nm, to prevent the smaller external additive particles to sink into toner base particles. In this case, it is preferable that the polarity of the larger external additive particles is the same as that of the toner, that is, positive, and the absolute value of the charge amount of the larger external additive particles is greater than that of the toner. When external additive particles having a mean particle size of 30 nm or more are added to the toner, the external additive particles act as spacers among the toner particles and prevent the toner from being frictionally charged. Thus, the charge amount of the toner tends to be reduced. As a result, it becomes much harder to continuously form solidly shaded images. However, if the larger external additive particles are adjusted preferably as described above, the charging property of the larger external additive particles is improved and thus the charging property of the toner is improved. As a result, stable, solidly shaded images can be formed continuously.

In the color laser printer 1 of this embodiment, impression development is adopted, in which the developing roller 25 and the photosensitive drum 18 make contact with each other. Impression development is advantageous in that it requires only a simple structure and does not require application of AC voltages, compared to non-contact development that is performed by applying DC or AC voltages between the developing roller 25 and the photosensitive drum 18, which are out of contact with each other, to jump the toner. On the other hand, the impression development is disadvantageous in that the density of halftone color of a visible image to be developed is directly affected by the charging condition of the toner and tends to fluctuate, because the impression development requires contact between the developing roller 25 and the photosensitive drum 18 with intervention of the toner.

However, in the above-described embodiment, the density of halftone color of a visible image to be developed is stabilized by keeping the charge amount per unit weight of toner constant. Thus, even when the impression development is adopted, a high-quality halftone color image can be reproduced.

In this embodiment, a colorless charge control agent is used for cyan, magenta, and yellow toner. Colorless charge control agents are limited in type, and are not charged well and are slow to be charged. Thus, variations in density caused by different development histories are likely to occur. However, in the color laser printer of this embodiment, even when such a colorless charge control agent is used, a high-quality halftone color image can be reproduced.

Although, in the above-described embodiment, the color laser printer 1 has a plurality of developing cartridges 24, the invention may be applied to a laser printer that is designed to form a monochrome image and has only one developing cartridge. As described above, effects produced by the invention are remarkable when toner that does not contain carbon black is used. Conversely, remarkable effects are not produced by a monochrome laser printer.

Although, in the above-described embodiment, the photosensitive drum 18 is used as a photosensitive member, a photosensitive belt may be used instead. Instead of positively charged toner, negatively charged toner may be used.

Although, in the above-described embodiment, the color laser printer adopting an intermediate transfer method is used, a color laser printer adopting a tandem method may be used.

The invention will be further described specifically with reference to experimental examples. It is noted that the invention is not limited by the following experimental examples.

A laser printer having a structure as described below was used as an image forming apparatus.

The basic structure of the laser printer used in the example is substantially the same as that of the laser printer 1 described above.

A developing roller having a roller part made of a urethane rubber or a silicone rubber was used. A layer thickness-regulating blade formed by bending a SUS plate spring of 0.1 mm in thickness was used. The curvature (R) of a bent portion was 1.0 mm.

Positively charged non-magnetic single-component toner of a mean particle size of 9 μm was used as pulverized toner. The pulverized toner is mainly composed of a positively charged polyester resin that is obtained through pulverization, and contains a positively charged CCR (charge control resin) as a charge control agent, cyan as a coloring agent, wax , and the like, and further contains, in proportions shown in Table 1,an external additive of negatively charged silica of a mean particle size of less than 30 nm that has gone through a known surface treatment with silicone oil.

Positively charged non-magnetic single-component toner of a mean particle size of 9 μm was used as polymerized toner. The polymerized toner is mainly composed a positively charged styrene-acryl copolymer that is obtained through suspension polymerization, and contains a positively charged CCR (charge control resin) as a charge control agent, cyan as a coloring agent, wax, and the like, and further contains, in proportions shown in Table 1, an external additive of negatively charged silica of a mean particle size of less than 30 nm that has gone through a known surface treatment with silicone oil.

EXPERIMENT 1

Figure 2:
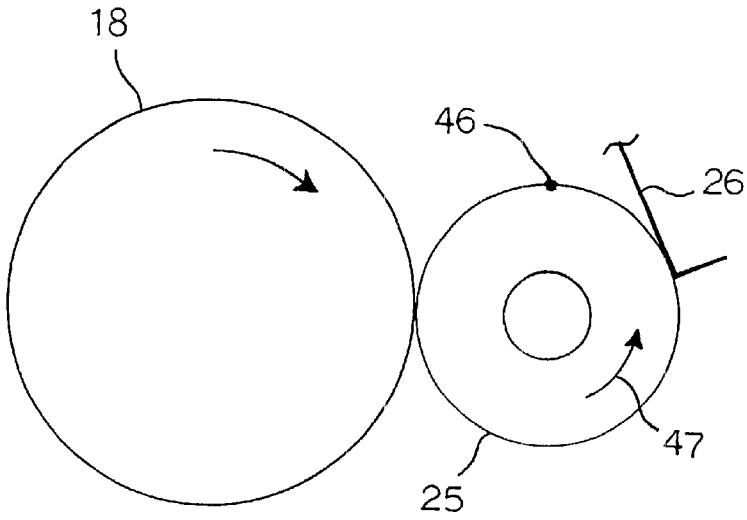
FIG. 2 is an enlarged sectional view of essential parts showing a portion of a developing roller, which is downstream, with reference to its rotation direction, of a position at which a layer thickness-regulating blade presses the developing roller and upstream of a position at which the developing roller faces the photosensitive drum.

Printing was performed by the laser printer 1, by selecting the material of the developing roller 25, the type of toner, and the amount of negatively charged silica, based on the combinations shown in Table 1. The weight per unit area $m_1$ [mg/cm$^2$] of the toner, which is carried on the developing roller and used for the next development after a blank image has been formed on the entire surface of the photosensitive drum 18, and the weight per unit area $m_2$ [mg/cm$^2$] of the toner, which is carried on the developing roller and used for the next development after a solidly shaded image has been formed on the entire surface of the photosensitive drum 18, were measured. Measurements were carried out at a position indicated by numeral 46 in FIG. 2.

In addition, evaluation as to whether ghosts were produced was visually performed. In Table 1, the type of ghosts produced (negative or positive) is shown in the parentheses.

TABLE 1

| No. | Developing roller | Toner | Amount of small-particle silica [% by weight] | Weight of toner $m_1$ [mg/cm$^2$] | Weight of toner $m_2$ [mg/cm$^2$] | $m_2/m_1$ (c) | Production of ghosts |
|---|---|---|---|---|---|---|---|
| 1 | Silicone rubber | Pulverized toner | 0.2 | 1.03 | 0.34 | 0.33 | x (negative ghost) |
| 2 | Silicone rubber | Pulverized toner | 0.4 | 0.86 | 0.38 | 0.44 | x (negative ghost) |
| 3 | Silicone rubber | Pulverized toner | 0.6 | 0.73 | 0.41 | 0.56 | x (negative ghost) |
| 4 | Silicone rubber | Pulverized toner | 0.8 | 0.62 | 0.43 | 0.69 | x (negative ghost) |
| 5 | Silicone rubber | Pulverized toner | 1.0 | 0.55 | 0.44 | 0.80 | ● |
| 6 | Silicone rubber | Pulverized toner | 1.2 | 0.50 | 0.44 | 0.88 | ○ |
| 7 | Silicone rubber | Pulverized toner | 1.4 | 0.47 | 0.44 | 0.94 | Δ (positive ghost) |
| 8 | Silicone rubber | Pulverized toner | 1.6 | 0.44 | 0.44 | 1.00 | x (positive ghost) |
| 9 | Urethane rubber | Polymerized toner | 0.2 | 0.82 | 0.36 | 0.44 | x (negative ghost) |
| 10 | Urethane rubber | Polymerized toner | 0.4 | 0.69 | 0.38 | 0.55 | x (negative ghost) |
| 11 | Urethane rubber | Polymerized toner | 0.6 | 0.50 | 0.40 | 0.67 | x (negative ghost) |
| 12 | Urethane rubber | Polymerized toner | 0.8 | 0.54 | 0.41 | 0.76 | Δ (negative ghost) |
| 13 | Urethane rubber | Polymerized toner | 1.0 | 0.51 | 0.41 | 0.80 | ● |
| 14 | Urethane rubber | Polymerized toner | 1.2 | 0.49 | 0.41 | 0.84 | ○ |
| 15 | Urethane rubber | Polymerized toner | 1.4 | 0.48 | 0.42 | 0.88 | ● |
| 16 | Urethane rubber | Polymerized toner | 1.6 | 0.47 | 0.42 | 0.89 | ● |

○: no ghosts
●: few ghosts
Δ: some ghosts observed but no problem presented for practical use
x: ghosts clearly observed and problems presented for practical use As is apparent from Table 1, ghosts presenting problems for practical use were observed in experimental examples 1–4 and 8–11 where c ($m_2/m_1$) was outside the range of 0.75 to 0.95. Conversely, under the conditions of experimental examples 5–7 and 12–16 where c ($m_2/m_1$) was within the range of 0.75 to 0.95, adequate levels for practical use were maintained without any problems. In these examples, no variations in density were produced and thus there was no problem with image quality. As described above, ghosts were produced when variations in density were produced.

Experiment 2

1) An endurance test of printing 5,000 sheets was conducted for experimental examples 5–7 in which pulverized toner was used and to which x was not given as a result of the evaluation in experiment 1. Thin spots were produced at lower portions of solidly shaded images.
2) An endurance test of printing another 5,000 sheets was conducted for experimental examples 5–7, using pulverized toner to which negatively charged silica of a mean particle size of 40 nm was externally added by 0.6% by weight. Although image quality was improved to some extent, thin spots were still produced at lower portions of solidly shaded images.
3) An endurance test of printing another 5,000 sheets was conducted for experimental examples 5–7, using pulverized toner to which positively charged titanium oxide of a mean particle size of 40 nm was externally added by 0.6% by weight, instead of negatively charged silica of a mean particle size of 40 nm, which was used in 2). No thin portions were produced at all in solidly shaded images. That is, degradation of image quality was prevented by use of a positively charged large-particle external additive.
4) An endurance test of printing another 5,000 sheets was conducted for experimental examples 5–7, using pulverized toner, to which positively charged silica of a mean particle size of 40 nm having undergone a surface treatment with a silicone modified using an amino group, was externally added by 0.6% by weight, instead of negatively charged silica of a mean particle size of 40 nm, which was used in 2). Thin potions in solidly shaded images were reduced considerably but to a lesser extent than in 3) That is, degradation of image quality was lessened by use of a positively charged large-particle external additive.

Experiment 3

1) An endurance test of printing 5,000 sheets was conducted for experimental examples 12–16 in which polymerized toner was used and to which x was not given as a result of the evaluation in experiment 1. No observable thin spots were produced in solidly shaded images.

2) An endurance test of printing another 5,000 sheets was conducted for experimental examples 12–16, using pulverized toner to which negatively charged silica of a mean particle size of 40 nm having undergone a surface treatment with a silicone oil was externally added by 0.6% by weight. No thin spots were produced in the solidly shaded images, either. However, it is believed degradation of image quality was better prevented by use of a large-particle external additive.

Experiment 4

Each of the toner and each of the external additive agents used in the above-described experiments, that is, pulverized toner and polymerize toner, negatively charged silica of a mean particle size of 40 nm, positively charged titanium oxide of a mean particle size of 40 nm, and positively charged silica of a mean particle size of 40 nm having undergone a surface treatment with a silicone modified using an amino group, is mixed with a reference carrier, and the charge amount of each of the toner and the external additive agents was measured. Measurements were made using a blowoff particle charge amount measuring device (manufactured by Toshiba Chemical Corporation). As a result, negatively charged silica showed a negative charge amount, and positively charged titanium oxide and positively charged silica were greater, in the charge amount, than pulverized toner and polymerized toner.

What is claimed is:

1. A developing apparatus, comprising:

a developing agent carrier that carries thereon a non-magnetic single-component developing agent;

a layer thickness-regulating member that presses a surface of the developing agent carrier, the developing agent being charged by friction when passing between the developing agent carrier and the layer thickness-regulating member, and forms a thin layer of the developing agent on the developing agent carrier; and a photosensitive member on which an electrostatic latent image is formed, and on which a visible image is formed from the electrostatic latent image when the thin layer of the developing agent on the developing agent carrier is deposited onto the electrostatic latent image, wherein a charge amount per unit weight of previously carried and recharged developing agent is substantially equal to a charge amount per unit weight of newly carried developing agent.

2. The developing apparatus according to claim 1, wherein when $m_1$ represents a weight per unit area of a thin layer of the developing agent that is pressed by the layer thickness-regulating member while having been carried on the surface of the developing agent carrier that corresponds to an area of the photosensitive member where no visible image has been formed, and $m_2$ represents the weight per unit area of a thin layer of the developing agent that is pressed by the layer thickness-regulating member after being newly supplied to the surface of the developing agent carrier that corresponds to an area of the photosensitive member where a solidly shaded visible image has been formed, an equation that $m_{2<m1}$ is satisfied.

3. The developing apparatus according to claim 2, wherein the developing agent is a color developing agent that contains no carbon black.

4. The developing apparatus according to claim 2, wherein c is within a range of 0.80 to 0.90 ($0.80 \leqq c \leqq 0.90$).

5. The developing apparatus according to claim 2, wherein the developing agent is polymerized toner obtained by polymerizing a copolymerizable monomer.

6. The developing apparatus according to claim 2, wherein the developing agent contains different kinds of external additives, and at least one kind of external additive is 30 nm or more in mean particle size and is identical, in polarity, with the developing agent, and greater, in absolute value of the charge amount, than the developing agent.

7. The developing apparatus according to claim 6, wherein the developing agent carrier is formed by a urethane roller, and the developing agent is positively charged polymerized toner that contains, as an external additive, 1.0–1.6% by weight of silica having a mean particle size of less than 30 nm.

8. The developing apparatus according to claim 2, wherein the developing agent carrier and the photosensitive member are designed to make contact with each other with intervention of the developing agent.

9. The developing apparatus according to claim 2, wherein $m_2 = cm_1$ ($0.75 \leqq c \leqq 0.95$).

10. An image forming apparatus, comprising:

a developing unit including a plurality of the developing apparatuses, each developing apparatus comprising:

a developing agent carrier that carries thereon a non-magnetic single-component developing agent;

a layer thickness-regulating member that presses a surface of the developing agent carrier, and forms a thin layer of the developing agent on the developing agent carrier;

a photosensitive member on which an electrostatic latent image is formed, and on which a visible image is formed from the electrostatic latent image when the thin layer of the developing agent on the developing agent carrier is deposited onto the electrostatic latent image, wherein a charge amount per unit weight of the thin layer of the developing agent formed by the layer thickness-regulating member is substantially constant, each of the developing apparatuses storing a developing agent of its own color different from others;

an intermediate transfer medium to which an image developed on the photosensitive member is transferred;

a feed unit, opposed to the intermediate transfer medium, for feeding a sheet;

a transfer unit that transfers the image on the intermediate transfer medium to the sheet; and a fixing unit disposed downstream of the transfer unit in a feeding direction of the sheet, the fixing unit melting and fixing the image on the sheet, wherein when $m_1$ represents a weight per unit area of a thin layer of the developing agent that is pressed by the layer thickness-regulating member while having been carried on the surface of the developing agent carrier that corresponds to an area of the photosensitive member where no visible image has been formed, and $m_2$ represents the weight per unit area of a thin layer of the developing agent that is pressed by the layer thickness-regulating member after being newly supplied to the surface of the developing agent carrier that corresponds to an area of the photosensitive member where a solidly shaded visible image has been formed, an equation that $m_2=cm_1$ $(0.75 \leqq c \leqq 0.95)$ is satisfied.

11. The image forming apparatus according to claim 10, wherein the developing unit is rotatable and, as the developing unit rotates, each of the developing apparatuses sequentially comes to face the photosensitive member and develops an image using the developing agent of its own color, and the developed images of different colors are sequentially transferred to the intermediate transfer member and superimposed one image on another, and the transfer unit transfers the superimposed images to the sheet.

* * * * *

UNITED STATES PATENT AND TRADEMARK OFFICE

CERTIFICATE OF CORRECTION

PATENT NO. : 6,456,813 B1 
DATED : September 24, 2002
INVENTOR(S) : Shougo Sato

It is certified that error appears in the above-identified patent and that said Letters Patent is hereby corrected as shown below:

Column 14,
Line 7, replace "$m_{2<m1}$" with -- $m_2<m_1$ --

Signed and Sealed this

Twenty-eighth Day of January, 2003

JAMES E. ROGAN
*Director of the United States Patent and Trademark Office*